United States Patent [19]

Cairns

[11] Patent Number: 4,948,377

[45] Date of Patent: Aug. 14, 1990

[54] SUBMERSIBLE ELECTRICAL CONNECTOR

[76] Inventor: James L. Cairns, 2348 Kentucky Ave., Mims, Fla. 32754

[21] Appl. No.: 383,293

[22] Filed: Jul. 17, 1989

Related U.S. Application Data

[63] Continuation of Ser. No. 157,645, Feb. 18, 1988, abandoned.

[51] Int. Cl.[5] ..... H01R 4/60

[52] U.S. Cl. ..... 439/200; 439/201; 439/271

[58] Field of Search ..... 439/271–283, 439/190–196, 206

[56] References Cited

U.S. PATENT DOCUMENTS

| | | | |
|---|---|---|---|
| 3,643,207 | 2/1972 | Cairns | 339/96 |
| 3,729,699 | 4/1973 | Briggs et al. | 439/199 |
| 3,845,450 | 10/1974 | Cole et al. | 439/141 |
| 4,085,993 | 4/1978 | Cairns | 339/94 M |
| 4,142,770 | 3/1979 | Butler, Jr. et al. | 439/140 |
| 4,373,767 | 2/1983 | Cairns | 439/199 |
| 4,606,603 | 8/1986 | Cairns | 350/96.21 |

*Primary Examiner*—David L. Pirlot

*Attorney, Agent, or Firm*—Brown, Martin, Haller & Mc Clain

[57] ABSTRACT

A submersible connector of the plug and receptacle type intended for use in environments characterized in having high or variable pressures includes a fluid-filled bladder into which open a plurality of ports for receiving a plurality of electrical probes. The internal environment of the bladder protects electrical contacts with which the probes mate to form electrical circuits. The integrity of the bladder environment is maintained by use of an end seal providing a radial constricting force on each of the ports, which acts to form a pressure-tight seal on a probe inserted into the port to complete an electrical connection. The integrity of the internal bladder environment is maintained when the probe is withdrawn by means of a plurality of socket assemblies, internal to the bladder, each associated with a respective one of the ports and including a movable stopper which initially protrudes through the socket assembly into the port. The constrictive force exerted through the port maintains a seal that protects the internal environment of the bladder. When a probe is inserted through the port, the probe engages the stopper and pushes it out of the port and back into the socket assembly. A return mechanism maintains a return force on the stopper acting against the probe, so that the stopper is moved into the port simultaneously with the probe being withdrawn from it.

3 Claims, 4 Drawing Sheets

SUBMERSIBLE ELECTRICAL CONNECTOR

This is a continuation of Ser. No. 157,645, filed 2/18/88, now abandoned.

BACKGROUND OF THE INVENTION

The invention concerns underwater electrical connectors, and more particularly concerns underwater connectors which use bladder assemblies to shield connector contact surfaces from contamination by the high-pressure salt water environment in which the connector is used.

The Inventor has pioneered the use of flexible, fluid-filled bladders with self-sealing ports to protect contact surfaces in underwater connectors. The genesis of this significant development in undersea connector technology is found in the Inventor's U.S. Pat. Nos. 3,643,207; 4,085,993; and 4,606,603. Essentially, these patents teach the use of a flexible, fluid-filled chamber in a connector for pressure equalization between a protective environment internal to the bladder in which connector contact surfaces are disposed, and the high-pressure corrosive sea water environment of the deep ocean in which the connector is deployed. An electrical (or optical) pathway is completed by insertion of a contact-carrying male probe through a reclosable end seal integral with the bladder. When the probe extends through the end seal, a barrier between the interior of the bladder and the outside environment results from the pressure of the end seal material against the probe. When the probe is withdrawn, the barrier must be maintained. The inventor has found that environmental sealing cannot rely solely on the compression of the end seal material, because the material, "forgets" to close, especially when mated to a probe for a long period of time in cold ocean water. This reluctance to close results in the leakage of fluid from the interior of the bladder and water into the bladder. Since the connecting surfaces within the bladder (in the form of sockets) are contained within the common chamber formed by the bladder, entry of water into the bladder poses the risk of conductive path formation between multiple sockets.

A significant developmental stage in the progress of the fluid-filled bladder technology was reached with design of a coaxial connector having a long, sturdy male probe in a holder, which supported multiple conductive paths. In addition, in the bladder, the end seal operation was enhanced by use of annular constricting elements for each passage through the end seal. The constrictive elements wiped a probe clean as it entered and held tightly against it while inserted; however, under situations of long mating times and low temperatures, the improved end seal would close slowly, allowing an exchange of fluid and sea water between the bladder and the surrounding ocean environment. Furthermore, addition of the constricting elements resulted in high insertion forces, because the male probe had to struggle mechanically against them to penetrate the passages closed by the end seal. Withdrawal of a probe was resisted by high withdrawal forces produced by the additional constricting elements acting against the probe. If the connector was mated for any length of time, the rubber material of the end seal would be held very tightly against the probe by the constricting elements, thereby causing it to conform on a microscopic basis to the irregularities on the surface of the probe and making withdrawal difficult, at best.

The invention laid out in the description to follow advances the fluid-filled bladder technology for submersible connectors by reducing the high insertion and withdrawal forces at the last stage of technology development. In addition, the present invention provides environmental isolation between multiple sockets within the fluid-filled bladder, thereby providing conductive isolation in the event of intrusion of sea water within the bladder.

The invention described below is meant for practice primarily in the undersea environment, where the threats of corrosion, pressure, low temperature, and environmentally-caused parasitic conductivity can significantly undermine the operation of connectors. However, the inventor contemplates the use of his invention in other contexts; fot example, in explosive environments such as are encountered in grainaries, mines, or fuel farms.

The principal objective of the described invention is to provide a submersible connector utilizing a fluid-filled bladder containing a plurality of sockets and having an end seal through which a plurality of probes are inserted for connection with the sockets, the connector providing a highly reliable barrier against the threats posed by the undersea environment.

A further objective is to provide such a connector with the ability to be connected With a minimum of insertion force and disconnected with a minimum of extraction force while deployed undersea.

An advantage of the invented connector is the electrical isolation of sockets within the fluid-filled bladder through the provision of a respective sealed environment for each connector.

SUMMARY OF THE INVENTION

The invention is based upon the realization by the inventor that a movable stopper operating within the fluid-filled bladder environment of the connector and protruding through an end seal port through which a connector probe is inserted maintains the pressure seal integrity of the interior of the bladder without the need for the constricting elements of the prior art, by acting in place of the probe to form a seal when the probe is removed. When the probe is inserted, the stopper is moved by the probe to a retracted position within the bladder environment. The stopper thus eliminates the requirement for the constricting elements and, therefore, reduces the insertion and extraction forces required for operation of the connector.

The inventor has made the further critical observation that each socket within the fluid-filled bladder can be isolated from all other sockets by provision of a separate bladder module enclosing the socket.

The invention, therefore, has three aspects: the first directed toward the structure of each socket within the connector, the second to the combination of the socket with a fluid-filled bladder in the receptacle of the connector, and the last to the combination of such a receptacle with a plug having a plurality of probes for forming a plurality of circuits.

The first aspect of the invention, then, includes an electrical socket having a flexible, dielectric chamber with two ends and a first passageway opening in a first end of the chamber. A dielectric stopper is movably disposed in the first passageway for moving between a first position at which the stopper extends through the first passageway and a second position at which the stopper is retracted into the chamber from the first passageway. A watertight seal surrounds the first passageway and has means which exert a radially constrictive sealing force on the stopper. An electrical contact is disposed at a position in the passageway which is exposed by movement of the stopper to the second position. A return mechanism (in the form of a spring in the Description) acts between the socket chamber and the stopper for moving the stopper from the second to the first position.

In the socket, the stopper has the form of an elongate piston with a cylindrical seat disposed in the chamber and a cylindrical tip disposed in the passageway. The chamber is preferably a cylindrical chamber, filled with a dielectric fluid, and the stopper cylindrical seat is contoured to permit the flow of the fluid within the chamber when the stopper is moved.

In its second aspect, the invention is a receptacle for a submersible connector, and includes a receptacle shell within which is disposed a fluid-filled bladder assembly having a plurality of ports opening into the bladder assembly. An electrical socket assembly is disposed within the bladder assembly in alignment with a respective port and includes a movable stopper disposed in the electrical socket assembly and including an elongate tip. The stopper is movable between a first position in which the tip protrudes into the port, and a second position in which the tip is retracted from that port. An end seal means is provided in the bladder assembly for constricting the respective passageway into a watertight sealing engagement with the elongate stopper tip.

In the third of its aspects, the invention is a submersible connector including a receptacle with a receptacle shell, a fluid-filled bladder assembly disposed in the receptacle shell, an end seal in the bladder assembly that includes a plurality of ports and a means for exerting a radially constrictive force through each of said ports, and a first alignment mechanism. The connector also includes a plug with a plug shell for receiving the receptacle shell, a plurality of electrical probes in the plug shell, each for being inserted into the bladder assembly through a respective one of the ports and for forming water tight seal with that port, and a second alignment mechanism for engaging the first alignment mechanism to align the probes with the ports. The receptacle further includes a plurality of electrical socket assemblies within the b)adder assembly, each of the electrical socket assemblies being in alignment with a respective one of the ports and each including a stopper movably disposed in the electrical socket assembly and including an elongate tip. The stopper of each electrical socket assembly is movable by a respective one of the probes from a first position in which the elongate tip protrudes into and forms a water tight seal with a respective one of the ports to a second position in which the tip is retracted into the socket assembly.

The summarized invention, therefore, achieves the objective of lower insertion and extraction forces by provision of the stopper in each electrical socket assembly, and further increases the environmental isolation of each socket assembly by providing a double prophylaxis against the surrounding environment consisting of the fluid-filled bladder assembly in which the sockets are disposed and a flexible dielectric chamber with a watertight seal enclosing each socket within the bladder assembly.

The achievement of these and other objectives and advantages by the invented connector will be understood when the Detailed Description of the Invention, given below, is read with reference to the next-summarized illustrations, in which.

DETAILED DESCRIPTION OF THE PREFERRED EMBODIMENT

Figure 1:
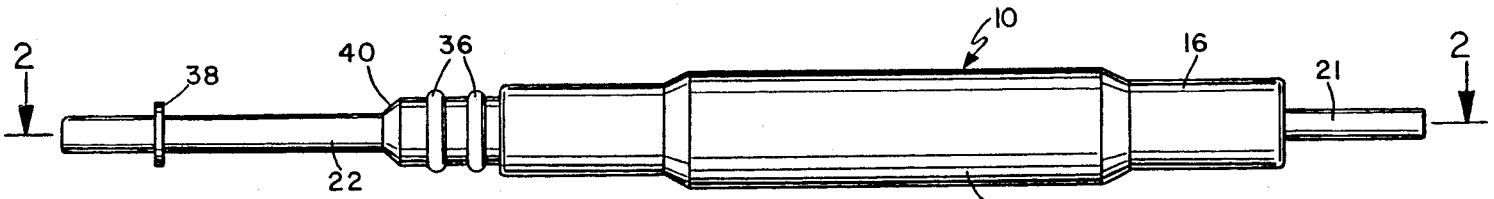
FIG. 1 is a side elevation view of an electrical socket assembly.

FIGS. 1-5 illustrate, in various levels of detail, the structure and operation of an electrical socket assembly which is used in the invention. The electrical socket assembly 10 includes an outer module 12 made of a flexible, elastic, nonconductive material, such as a natural or synthetic rubber. The module 12 essentially forms a bladder, or chamber, within which an electrical socket structure is disposed. An end seal 14 is formed in the module for sealing the back end of the module. An entry lip seal 16 is formed in the forward end of the module. The module 12 is essentially cylindrical in shape, with both of the seals 14 and 16 consisting of annular structures, each pierced through with a passageway opening into the module 12. The material from which the module 12 is formed is elastic so that the seals 14 and 16 radially constrict against objects inserted into their respective passageways to form therewith respective barriers resistant to fluid and pressure. A dielectric fluid 18 fills the interior of the module 12. The fluid 18 has the same characteristics as the fluid which fills the bladders of the Inventor's cited U.S. Patents, and is used for the same purposes. A movable dielectric stopper 20 has a forward extension, or tip 21, which extends through the passageway formed in the entry lip seal 16. The stopper 20 is free to slide within the module 12. The radially constrictive force exerted by the lip seal 16 through the passageway seals the lip seal 16 against the stopper tip 21 to form a fluid and pressure resistant barrier. The barrier prevents the transfer of fluid between the interior and exterior of the module 12.

Figure 5:
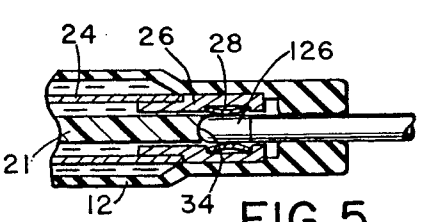
FIG. 5 is a view similar to that of FIG. 4 showing complete insertion and connection of a probe in the electrical socket assembly of FIG. 2.
Figure 4:
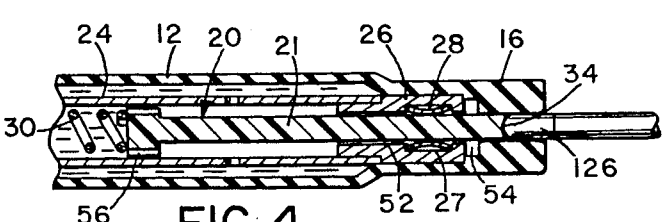
FIG. 4 is a view similar to a portion of FIG. 2, showing partial insertion of a probe into the electrical socket assembly of FIG. 2.

With reference to FIGS. 4 and 5, it will be evident that, as a probe 126 is inserted into the module 12 through the entry lip seal 16, the probe will engage the end of the stopper tip 21, pushing it into a retracted position within the module 12. The probe 126 follows the stopper tip on its trip into the interior of the module 12, thereby replacing the stopper tip 21 in the barrier formed with the entry lip seal 16. When the probe is withdrawn, the stopper tip 21 follows the probe as it leaves the passageway in the entry lip seal 16, and replaces the probe in the barrier formed with the lip seal 16. One will appreciate that the mating and demating of a probe with the electrical socket assembly does not require expansion of the passageway in the lip seal 16 when the probe is inserted, nor contraction of the passageway when the probe is removed. Since the stopper 20 eliminates the requirement for closing the entry lip seal 16 when the probe is withdrawn, the need for the constricting elements for the prior art bladder assemblies is eliminated, thereby reducing the insertion and extraction forces necessary for mating and demating the electrical socket assembly 10 with a probe.

Returning to FIGS. 1 and 2, electrical conductivity is provided within the socket assembly 10 by a conductive rear piece 22, a cylindrical conductive tube 24, a conductive forward piece 26, and an annular contact band 28. Each of the elements 22, 24, 26, and 28 is made of an electrically conductive material. The rear piece 22 has an annular groove 23 for receiving and sealing to the inner end seal 14 of the module 12, and a forward extension 25 which is received in one of the tube 24. The tube 24 extends between the end piece 22 and the forward piece 26, which fits into the forward end of the tube 24. The forward piece 26 has a forward extension with an interior annular groove 27 in which the annular contact ring 28 is seated. Electrical conductivity is thus provided from the forward end of the module 12, out, through the rear end of the module.

A stopper return spring 30 is disposed inside the tube 24 and acts between the forward end of the end piece 22 in the rear end of the stopper 20.

Figure 2:
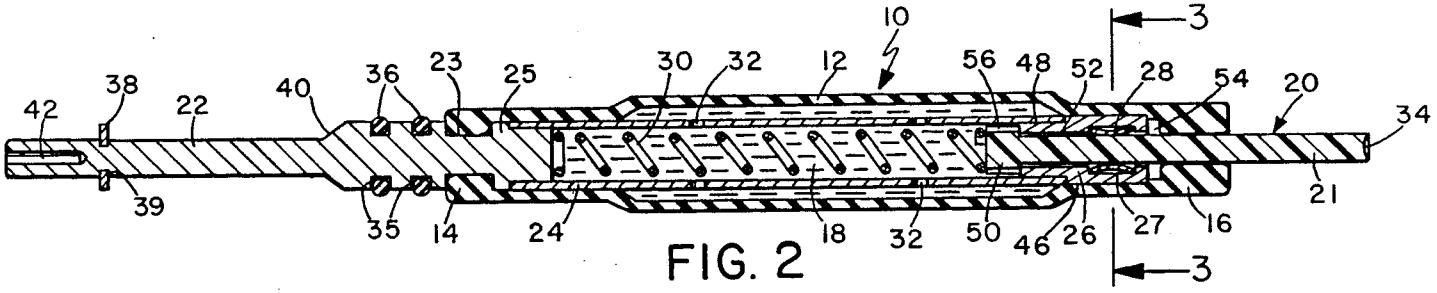
FIG. 2 is a sectional view taken on line 2—2 of FIG. 1.

When a probe is inserted into the electrical socket assembly 10 and moves the stopper 20 rearwardly within the tube 24, the dielectric fluid 18 is displaced somewhat by the rearward motion of the stopper. This results in a deformation of the module 12. As shown in FIG. 2, the fluid 18 is ported through radial holes 32 in the tube 24.

As shown most clearly in FIGS. 2, 4, and 5, the stopper tip 21 engages the end of a probe by means of a concave face 34 in the end of the tip 21. When the stopper 20 is pushed out of place by a probe, the probe enters the forward passageway through the entry lip 16 and engages the contact ring 28 to establish conductivity between the probe and the conduction apparatus in the socket assembly 10. As the probe is inserted through the entry lip seal 16, it pushes the stopper 20 rearwardly in the tube 24, thereby compressing the spring 30. The spring 30 is of such a dimension that the stopper 20 can be pressed into the tube 24 and will be recessed only to the point where the concave face 34 is displaced just to the rear of the annular contact ring 28 within the front piece 26. The bore of the front piece 26 acts as a longitudinal guide for the stopper tip 21, aligning it longitudingly with the passageway through the entry lip seal 16. Of course, when the probe is withdrawn from the passageway in the entry lip seal 16, the spring 30 urges the stopper 20 forward into the breach: the stopper follows the probe, until the probe is completely withdrawn. The spring 30 then continues stopper 20 forward until the large cylindrical seat 50 engages the shoulder 48 of the forward piece 26. The diameter of the cylindrical seat 50 is slightly less than the interior diameter of the tube 24, so that the tube 24 acts as a guide to the seat 50.

Figure 6:
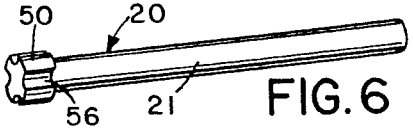
FIG. 6 is a perspective view of the stopper element.
Figure 3:
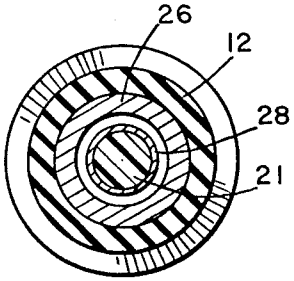
FIG. 3 is an enlarged sectional view taken on line 3—3 of FIG. 2.

As shown in FIGS. 2, 4, and 6, the enlarged cylindrical seat 50 of the stopper 20 is slotted by slots 56, to permit the fluid 18 to flow past the stopper 20 as the stopper is being displaced within the module 12.

As shown in FIGS. 1 and 2, the end-piece 22 includes a pair of annular grooves 35 that provide seats for a pair of O-ring seals 36. The end piece 22 has a tapered transition forming a load-bearing shoulder 40, and a solder pot 42 bored in its furthest tip. A snap-ring 38 is seated in an annular groove 39 formed just forward of the shoulder pot 42 in the outer surface end piece 22.

In summary, then, the structure of the electrical socket assembly illustrated in FIGS. 1–6, provides a protected environment for a contact surface (the ring 28), which is entered through an end seal 16. The stopper 20 ensures that the end seal 16 never has to close completely to a zero-diameter hole when a probe is withdrawn from it. The entry lip seal 16 acts against the stopper tip 21 and a male probe having a slightly larger diameter than the stopper tip. Thus, the entry lip seal 16 is always full of something, either the stopper tip 21, or a probe. There is never a requirement for the lip seal to substantially alter its dimensions. Therefore, only a minimal amount of stretch of the material of the module 12 is required for cycling a probe. Further, the entry lip seal 16 is a one-way seal in that it seals from the outside environment. Thus, the fluid 18 can flow from inside the module 12, which requires only enough internal high pressure to overcome the elasticity of the entry lip seal 16. The module material is selected to be substantiallY elastic, the entry lip seal 16 is not leaky. However, in the event that additional constrictive elements are required to maintain the integrity of the entry lip seal 16, one can appreciate that the insertion force required to move a probe into the seal 16 will still be substantially less with the arrangement illustrated in FIG. 2 than if the probe were required to open the passageway through the seal from a zero diameter.

One can contemplate an alternative embodiment of the entry lip seal 16 in the form of one or more O-rings disposed within the bore of the front piece 26, forward of the contact ring 28. The O-rings would be alternated with one or more annular dielectric pieces to seat the rings and to close the electrical path. Since the electrical socket assembly 10 is intended to be disposed within a bladder assembly in a receptacle, described below, no significant pressure differential would exist across these O-ring, thereby facilitating the movement of the socket tip 21 past the rings.

The integrity of the seal at the forward end of the electrical socket assembly 10 is enhanced by a conventional rubber-to-metal bond 46, which can be assisted or replaced by an external clamping collar on the outside of the module 12 over the forward piece 26.

A small annular cavity 54 is formed in the forward portion of the module 12 between the rear of the entry lip seal 16 and the forward end of the end piece 26. This is shown in FIGS. 2, 4, and 5. The cavity prevents a conductive path forming between the forward conductive part 26 and the external environment. Such a conductive path could be created by the small scratch through the lip seal caused by sand, or a burr, on a probe. Under certain circumstances, such scratches might contain traces of sea water with an electrically-conductive composition. In order to prevent conduction under such circumstances, the cavity 54 is filled with a dielectric fluid, thereby providing a dielectric barrier.

Figure 7:
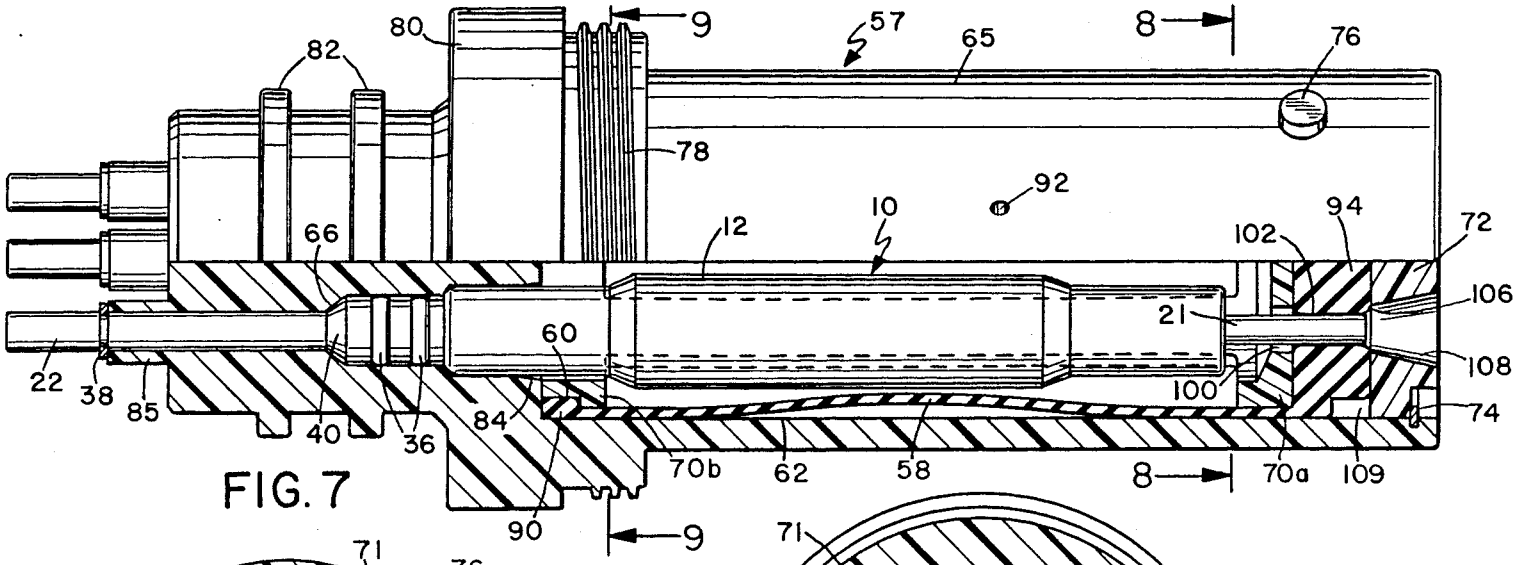
FIG. 7 is a side elevation view, in partial section of a connector receptacle including a plurality of electric socket assemblies.
Figure 9:
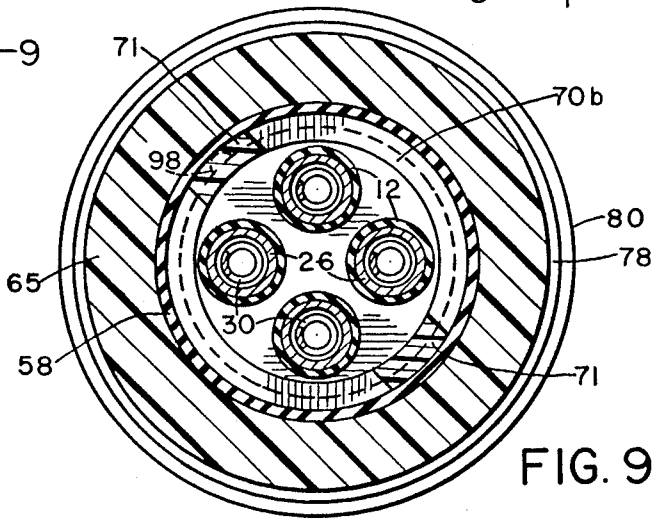
FIG. 9 is a sectional view taken along line 9—9 of FIG. 7.

Refer now to FIGS. 7–11 for an understanding of the second aspect of the invention. The second aspect of the invention includes a receptacle for a submersible electrical connector having a fluid-filled bladder which encloses a plurality of electrical socket assemblies identical with the one illustrated in FIGS. 1–6, and described above. The receptacle illustrated in FIGS. 7, 8, and 9 includes a receptacle shell 57 enclosing a fluid-filled bladder 58. The receptacle 57 includes an elongate sleeve 65, which is a substantially cylindrical piece having a rear portion with four through bores, each bore accepting the end of piece of a respective electrical socket assembly. In the description which follows, it is assumed that the electrical socket assemblies disposed in the receptacle shell 57 are identical to the one illustrated and described above. For convenience, the one socket assembly shown in side elevation in FIG. 7 is assumed to be the electrical socket assembly 10 of FIGS. 1–6.

Continuing the description, the electrical socket assembly 10 is seated in the rear portion of the elongate sleeve 65 in one of the four through bores provided through the sleeve rear portion. The electrical socket assembly 10 is seated by engagement of its load bearing shoulder 40 against a load bearing seat 66 in one of the through bores. The socket assembly 10 is retained in this position by the snap ring 38. The rearmost portion of the rear piece 22, that is, the portion wherein the solder pot 42 is located, projects out from the rear of the sleeve rear portion.

Figure 10:
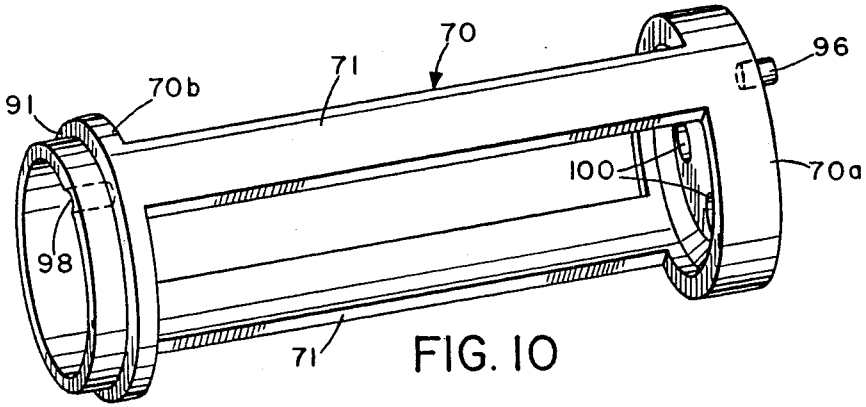
FIG. 10 is a perspective view of the bladder support used in the bladder assembly.

The bladder assembly 58 is formed from a flexible, elastic material such as natural or synthetic rubber; it is maintained in an elongated, cylindrical configuration by a bladder stretcher, or support, 70 (FIGS. 10). As can be seen from FIG. 10, the stretcher essentially consists of a pair of spaced annular portions 70*a* and 70*b* separated by a pair of support spacers 71. The bladder 58, with the stretcher 70 inserted into it, is placed in the interior bore of the receptacle sleeve 65. An end cap 72 (FIGS. 7 and 11) retains the bladder assembly in the receptacle sleeve bore. The end cap 72 is retained by a snap ring 74, at the forward end of the interior bore of the shell 65.

The structure of the receptacle shell 65 includes a mating key 76 on the outer surface of the sleeve 65, mating threads 78 at the bottom of the sleeve 65 and an enlarged-diameter shoulder 80 aft of the threads 78. Grip rings 82 are formed behind the shoulder 80, and boot seals 85 are provided to provide fluid and pressure seals against the rear extensions of the rear pieces in the four electrical socket assembly disposed in the receptacle 57.

Figure 8:
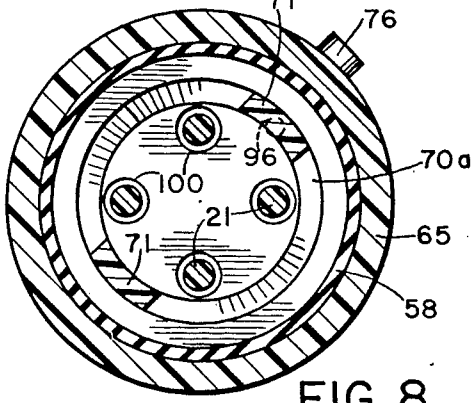
FIG. 8 is a sectional view taken along line 8—8 of FIG. 7.

The structure of the bladder assembly includes a rear seal 90 formed against a rear seal seat 91 in the rear portion 70*b* of the spacer 70. An end seal 94 is formed in the forward end of the bladder assembly. The end seal 94 of the bladder assembly includes four through passageways, or holes, that are aligned with four corresponding passageways, or holes, of the forward end of the stretcher assembly 70 by means of an end seal alignment key 96 on the stretcher. The alignment key 96 is received a corresponding keyway 98 of the end seal 94. The alignment key 96 is shown in FIGS. 7 and 8, and the keyway 98 in FIG. 9. One of the holes 102 in the end seal 94 is shown in FIG. 7 aligned with a corresponding hole 100 in the spacer assembly 70. The end cap 72 is also bored through with four holes 106, which are aligned to the holes of the end seal 94 by an alignment key 104. The alignment key 104 is seated in a corresponding keyway (not shown) in the end seal 94 to orient the holes 106 with the holes 102 in the end seal 94. As seen in FIG. 7, the end holes 106 of the end cap 72 are tapered at 108. The tapered surface 108 provides for guidance of a probe into the holes 102 in the end seal 94. The end cap 72 is mounted in the shell 65 to compress the end seal 94, thereby adding to the radially constricting force that the end seal applies on the holes 102.

Figure 11:
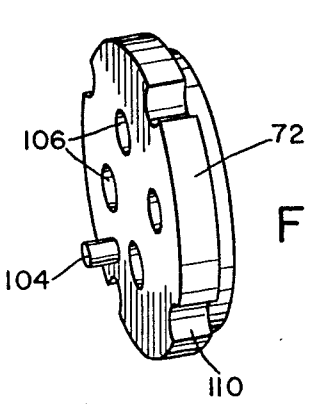
FIG. 11 is a perspective view of the receptacle end cap for retaining the bladder assembly.

An annular void 109 is formed between the end seal 94, the rear of the end cap 72, and the interior surface of the receptacle sleeve 65. The void 109 provides a space for the end seal 94 to slightly deform into, if necessitated by the passage of a probe into one of the holes 102. The bladder assembly is filled with the dielectric fluid which also fills the the module 12 (and each of the other three modules in the shell 65). The void 109 is vented to the outside environment through grooves 110 in the end cap 72 (FIG. 11).

The exterior surface of the fluid-filled bladder assembly 58 is vented to the outside environment through vent holes 92 in the receptacle shell 65. The venting provides for equalization of the pressure between the outside environment and the interior of the fluid-filled bladder assembly 58. This pressure equalization virtually eliminates pressure differential across the seals in the socket assembly 10 and the end seal 94.

As shown in FIG. 7, the electrical connector assembly 10 is disposed inside the bladder assembly 58 in alignment with an aligned set of holes including a spacer hole 100, an end seal hole 102, and an end cap hole 106. It will be evident that four sets of aligned holes provide a corresponding set of ports opening into the bladder assembly 58. For the respective port illustrated in FIG. 7, the electrical socket assembly is held in the receptacle shell and in the bladder assembly in alignment with the port. The socket assembly 10 is held in the receptacle by the snap ring 38, the assembly 10 being aligned with its respective port by the engagement of the shoulder 40 with the seat 66. The O-ring 36 seal the through bore in the rear portion of the receptacle sleeve to prevent fluid flow between the outside of the sleeve and the interior of the bladder. The alignment of the socket assembly 10 with the port consisting of the holes 100, 102, and 106 provides for the extension of the stopper tip 21 through the port. This is best shown in FIG. 7. Each of the other three ports (not shown) of the receptacle of FIG. 7 is similarly aligned with a respective socket assembly and receives the stopper tip from the aligned socket assembly. It will be evident that the stopper tip 21 acts as a stopper both for the electrical socket assembly module 12 and for the fluid-filled bladder assembly 58. Thus, for each socket in the multi-socket receptacle 57, there are two, independent fluid chambers, one contained within the other. One fluid chamber is the chamber formed by the module of the socket assembly, the other chamber being the larger bladder assembly 58. Since the bladder assembly 58 is filled with dielectric fluid, each chamber is electrically and environmentally separated and isolated from the other three sockets.

Now, one will appreciate that as a probe is inserted into the port illustrated by the cutaway portion of FIG. 7, it contacts the tapered surface 108, and is guided through the opening 106 into the end seal hole 102, where it contacts the concave face 34 of the stopper tip 21. When the probe engages the concave face 34, it pushes the stopper rearwardly into the socket assembly 10; thus, as the probe is inserted through the end seal 94 into the socket assembly 10, it displaces the stopper tip 21, under pressure from the spring 30, as described above. Also, when the probe is withdrawn from the receptacle port, the stopper tip 21 follows it back through the port. Thus, the end seal 94, being formed of an elastic material which is in compression, exerts a constricting force on the hole 102. The constricting force closes the hole 102 into a sealing engagement with the stopper tip 21, or with a probe tip. As with the forward passageway of the entry lip seal of the socket assembly 10, the end seal hole 102 is never required to compress so far as to close the hole 102. Since, as described above, the tip of a probe has a slightly larger diameter than the stopper tip 21, the insertion force required to place the probe tip contact with the connector surface inside the socket assembly and is minimized. At all times, the compressive end seal feature of the bladder assembly 58 maintains a barrier between the interior of the bladder assembly in the external environment in which the receptacle is deployed. The compression of the end seal 94 also acts to wipe the exterior surface of a probe clean when the probe is inserted into and extracted from the receptacle.

Figure 12:
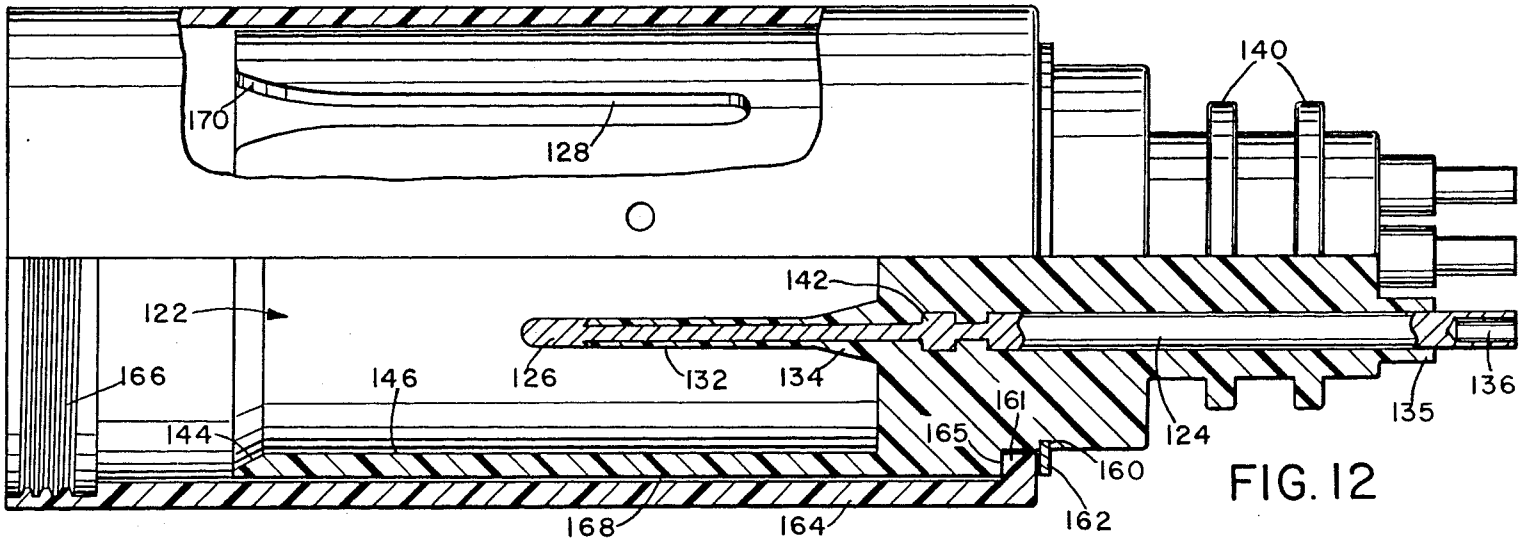
FIG. 12 is a side elevation view, in partial section, of a connector plug including a plurality of electrical probes.

The plug portion of the connector of the invention is illustrated in FIG. 12. For this embodiment, the plug assembly 120 includes a dielectric plug body 122 with four conductive elements, one of which is illustrated and indicated by 124. The conductive element 124 transitions to a conductive tip 126 at its forward end and, at its rearward end, to a solder pot 136. The plug body 122 is formed of a non-conductive material, while the conductive path consisting of the conductive tip 126, and the element 124 is formed of a conductive material, preferably a metal. The end portion of the conductive element 124 is sealed by a boot seal 135. As illustrated in FIG. 12, construction of the plug body 122 includes formation of a dielectric outer probe shell 132, which tapers at its base 134. The combination of the probe outer shell 132 with a tapered base 134 and the conductive tip 126 forms one of the four probes of the plug in FIG. 12. The other three probes are identical with the probe illustrated in FIG. 12. The tapered base 134 of the probe shell 132 enhances the mechanical reliability of the probe by increasing its strength. Further mechanical enhancement is provided by an enlargement 142 of the conductive element 124. As shown in FIG. 12, the plug body 122 is provided with grip rings 140 for ease of handling. These rings also enhance the strength of the bond between the material of the plug body 122 and the conductive elements. The plug body 122 has a mating keyway 128 with a flared entrance, 170, which engages the mating key 76 on the receptacle sleeve 65 of FIG. 7. When the plug body is brought together with the receptacle of FIG. 7, the plug body 122 is turned until the alignment key 76 is engaged by the flared opening 130. The plug body and receptacle shell are pushed together axially, while being slightly rotated on axis to enable the alignment key 76 to traverse into the narrow portion of the key way 128. The alignment of the FIG. 7 receptacle in the FIG. 12 plug assembly by way of the key 76 and key way 128 aligns the probes in the plug assembly with the ports in the receptacle assembly, so that each probe in the plug assembly is repeatedly mated with a respective socket in the receptacle assembly. Further, the alignment provided by the key 76 and keyway 128 orients the probes in the plug assembly with the end cap holes, so that each probe is initially aligned with a contact hole for being received into a respective end seal port.

The plug body 122 is assembled to a plug body locking sleeve 164 by means of a snap ring 162 which holds the rear lip 161 of the sleeve 164 between itself and a shoulder 165 in the plug body 122. The snap ring 162 is retained in an annular groove 160 formed on the rear portion of the plug body 122. Mating threads 166 are provided on the front inner surface of the locking sleeve 164, while the difference in diameters between the bore of the locking sleeve 164 and the forward extension of the plug body 122 provide for a small space 168 between the sleeve 164 and the body 122. The locking sleeve 164 is vented to the outside environment through holes (not shown). This venting provides an unobstructed Path between the surface of the bladder assembly 58 and the ambient environment when the receptacle and plug are mated. The ambient pressure reaches the bladder surface through the holes in the locking sleeve and then through the vent holes in the receptacle shell.

Figure 13:
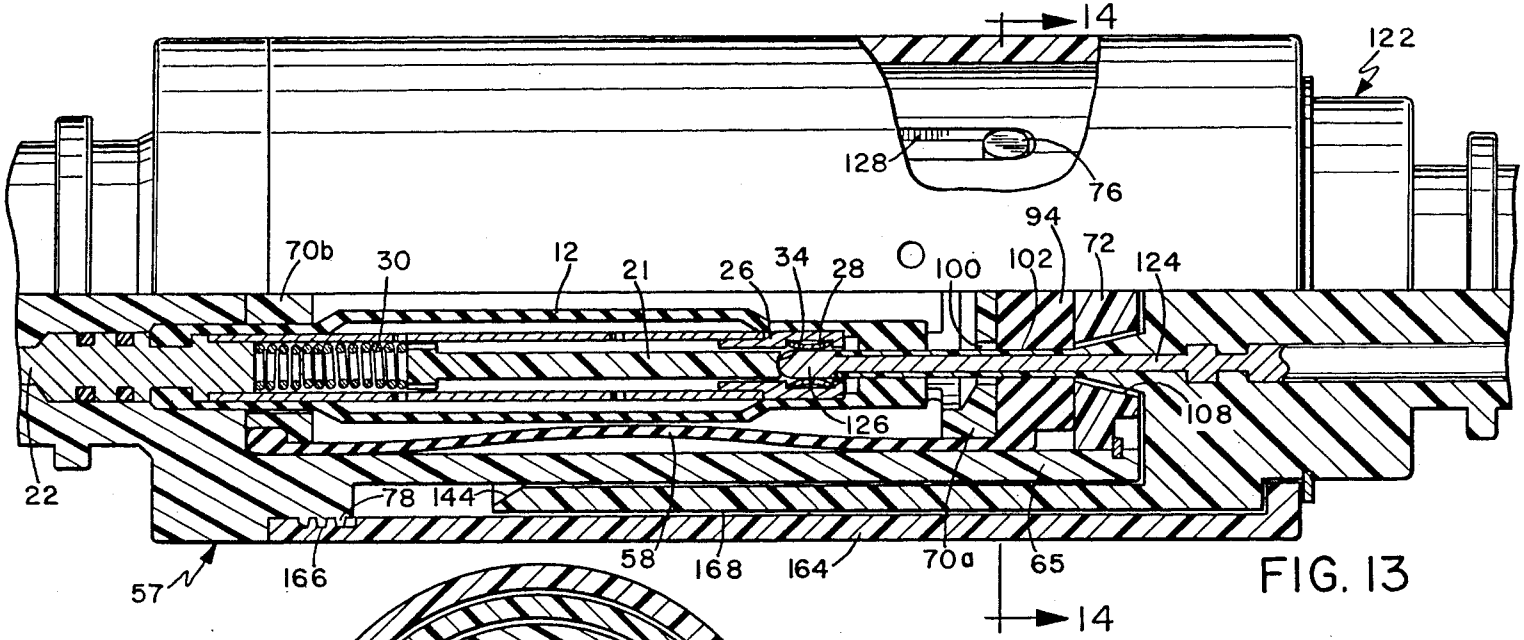
FIG. 13 is a side elevation view, in partial section, of the connected plug and receptacle units.
Figure 14:
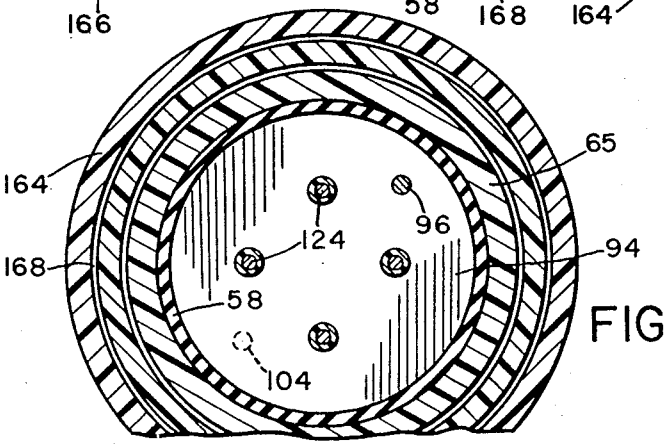
FIG. 14 is a sectional view taken along line 14—14 of FIG. 13.

The connection between the receptacle of FIG. 7 and the plug assembly of FIG. 12 is illustrated in FIGS. 13 and 14. As described above, the alignment key 76 is engaged by the keyway 128 to provide an initial alignment between the probes in the plug and the ports in the receptacle. The plug and receptacle are pushed together, with the threads 166 of the plug assembly engaging the threads 78 of the receptacle to retain the two connector halves in a mated operative engagement. As the two halves are brought together, each of the four probes in the plug assembly is aligned with and mated to a respective one of the four electrical socket assemblies. Since the manner of engagement between probe and socket is the same for each of the four probe/socket pairs, one description is given for the engagement of the probe tip 126 with the contact ring 28 in the socket assembly 10. As the connector halves are brought together, the probe tip 126 contacts the tapered surface 108 and is guided by it into contact with the concave recessed face 34 of the stopper tip 21. The probe tip 126 pushes through the end seal hole 102, the hole 100, and into the forward passageway in the entry lip seal of the socket assembly 10. Eventually, when the two connector halves are fully seated, the probe tip 126 has traveled into engagement with the connector ring 128, pushing the stopper tip 21 into its retracted position inside the electrical socket assembly 10. Electrical conductivity is thereby established from the conductive element 124 through the tip 126, the ring 28, forward piece 26, tube 24, and end piece 22. The spring 30 is fully compressed. When the two connector halves are demated, the probe tip 126 is withdrawn from the interior of the socket out through the port consisting of the holes 100, 102, and 106, while the stopper tip 21 is urged by the spring back 30 out through these holes.

Obviously, many variations of the invention are possible in light of these teachings which, when employed, will not deviate from the scope of the appended claims.

I claim:

1. A receptacle for submersible connector, comprising:

a receptacle shell;

a fluid-filled flexible bladder assembly disposed in said receptacle shell defining a first, outer chamber;

a plurality of first ports opening into said outer chamber;

a plurality of electrical socket assemblies disposed in said bladder assembly, each of said socket assemblies comprising an outer sheath defining a second, inner chamber having two ends, and a second port opening into one end of said inner chamber, each of said second ports being in alignment with a respective first port;

each of said socket assemblies including a stopper movably disposed in said chamber, said stopper including an elongate tip, said stopper being movable between a first position in which said tip protrudes through said second port into the respective, aligned first port and a second position in which said tip is retracted from said first and second ports into said inner chamber;

first seal means in said bladder assembly surrounding said first ports for receiving said tip in said first position and for exerting a radially constrictive sealing force on said tip to seal said first chamber; and second seal means surrounding each of said second ports for exerting a radially constrictive sealing force on said tip to seal said second chambers.

2. A submersible electrical connector, comprising:

a receptacle including:

a receptacle shell;

a fluid-filled resilient bladder assembly disposed in said receptacle shell;

an end seal in said bladder assembly, said end seal including a plurality of first ports and a means for exerting a radially constrictive force through each of said ports; and a first alignment mechanism;

a plug, including:

a plug shell for receiving said receptacle shell;

a plurality of electrical probes in said plug shell each of said probes for being inserted into said bladder assembly through a respective one of said ports and for forming a water tight seal with said respective port; and a second alignment mechanism for engaging said first alignment mechanism to align said probes with said ports;

a plurality of electrical socket assemblies in said bladder assembly, each of said electrical socket assemblies in alignment with a respective one of said ports, and each of said socket assemblies including a stopper movably disposed in said electrical socket assembly, said stopper including an elongated tip, said stopper being movable by a respective one of said probes from a first position in which said elongated tip protrudes into and forms a watertight seal with a respective one of said ports to a second position in which said tip is retracted into said socket assembly, and each of said socket assemblies comprises a flexible outer sheath defining an inner chamber, a dielectric fluid contained in each inner chamber, each inner chamber having a second port in alignment with a respective one of said first ports, said stopper tip protruding through said second and first ports in said first position, and a watertight seal surrounding each second port and including means for exerting a radially constrictive sealing force on said stopper tip.

3. A receptacle for a submersible connector comprising:

a receptacle shell;

a fluid-filled flexible bladder assembly disposed in said receptacle shell defining an outer chamber;

a first port opening into said bladder assembly;

an electrical socket assembly disposed in said bladder assembly in alignment with the first port;

a stopper movably disposed in said electrical socket assembly, said stopper including an elongated tip, said stopper being movable between a first position in which said tip protrudes into said port and a second position in which said tip is retracted from said port;

an end seal means in said bladder assembly for receiving said tip and for constricting said respective passageway into a watertight sealing engagement with said tip; and said socket assembly comprises a flexible sheath defining an inner chamber, a dielectric fluid contained in said inner chamber, said inner chamber having a second port in alignment with said first port, said stopper tip protruding through said second and first ports in said first position, an a watertight seal surrounding said second port and including means for exerting a radially constrictive sealing force on said stopper tip.

* * * * *